United States Patent [19]

Brulé

[11] Patent Number: 4,593,821

[45] Date of Patent: Jun. 10, 1986

[54] BELT SEPARATOR FOR BLOW MOLDING PARTS

[75] Inventor: Paul L. Brulé, Plainwell, Mich.

[73] Assignee: LaRos Equipment Company, Inc., Portage, Mich.

[21] Appl. No.: 726,861

[22] Filed: Apr. 25, 1985

[51] Int. Cl.[4] ..... B07B 1/15; B07B 1/10; B07B 13/04

[52] U.S. Cl. ..... 209/620; 209/660; 209/923; 425/522

[58] Field of Search ..... 209/307, 620, 659, 665, 209/681, DIG. 923

[56] References Cited

U.S. PATENT DOCUMENTS

| | | | |
|---|---|---|---|
| 937,213 | 10/1909 | Hough et al. | 209/620 X |
| 1,552,366 | 9/1925 | Wade et al. | 209/620 |
| 2,350,691 | 6/1944 | Mauroner | 209/620 |
| 2,686,591 | 8/1954 | Harden | 209/620 X |
| 3,115,169 | 12/1963 | Rodriguez et al. | 209/620 X |
| 3,150,022 | 9/1964 | Vida | 209/307 X |
| 3,653,509 | 4/1972 | Goodman et al. | 209/620 X |
| 3,704,780 | 12/1972 | Aidlin et al. | 209/923 X |
| 3,713,537 | 1/1973 | Walker | 209/665 X |
| 3,770,111 | 11/1973 | Greenwood et al. | 209/923 X |
| 3,998,330 | 12/1976 | Morgan | 209/620 |
| 4,535,894 | 8/1985 | Shell | 209/681 X |

OTHER PUBLICATIONS

Erico brochure entitled "Model BMS-2 Blow Molding Separator".

*Primary Examiner*—J. Howard Flint, Jr.
*Attorney, Agent, or Firm*—Flynn, Thiel, Boutell & Tanis

[57] ABSTRACT

A belt-type separator for effecting separation of blow-molded parts, which separator preferably includes at least two endless belts movably supported on and between a pair of horizontally spaced pulleys, one of which is a drive pulley. The belts, preferably of circular cross section, have the upper reaches extending in parallel but slightly sidewardly spaced relationship to define a small gap therebetween through which scrap parts can pass. The other parts remain on the belts and are transported to a discharge location. The belts are preferably driven at slightly different speeds to facilitate the agitation and dislodgement of the scrap parts so that they can move into and pass through the clearance spaces between adjacent belts.

16 Claims, 9 Drawing Figures

BELT SEPARATOR FOR BLOW MOLDING PARTS

FIELD OF THE INVENTION

This invention relates to a belt-type apparatus for effecting separation of different sized or shaped parts and, more particularly, to an apparatus for effecting separation of blow-molded bottles from the moils and tails.

BACKGROUND OF THE INVENTION

In the blow molding of bottles or similar containers, the blow molding operation results in the formation of a "tail" at the closed end of the bottle, which tail must be snapped off, this generally being accomplished during removal of the bottle from the blow molding machine. The blow molding operation also results in the formation of a ringlike collar (known in the trade as a "moil") around the opening to the bottle, which moil is cut off from the molded bottle substantially upon completion of the blow molding operation. The blow-molded bottles, tails and moils are then generally discharged from the blow-molding machine into a separator to effect separation of the bottles from the moils and tails, which latter components are scrap plastic and can be recycled.

At the present time, the separator most commonly used in the United States for blow molding employs a row of driven rolls provided with selected clearance gaps between adjacent rolls, whereby the apparatus resembles an elongate roller conveyor. The mixture of blow-molded bottles, moils and tails is deposited into a discharge chute which directs the mixture onto the roller conveyor. The driving of the rolls causes the parts to be conveyed therealong, and this ultimately results in orientation of the moils and tails such that they fall through the gaps between the rollers and onto an intermediate transfer conveyor which then causes the moils and tails to be discharged into a collection bin. The bottles, however, are transferred downwardly along the apparatus as it functions substantially as a roller conveyor so that the bottles can be discharged at a separate location.

While this latter device is extensively utilized, nevertheless this device possesses features which make its use less than desirable. For example, with this arrangement, it is difficult to adjust the gaps in a uniform fashion throughout the length of the roller arrangement. Such adjustment is a difficult and time-consuming endeavor, and makes the overall construction of the apparatus more expensive in view of the necessity of providing structure which permits such adjustment. Separators of this type are often utilized under conditions whereby an optimum gap is not provided since continual adjustment of the gap is unduly complex. Further, separators of this type have been observed to cause undesirable scratching or nicking of the blow-molded bottles or containers inasmuch as the rolls most often are formed as conventional metal conveyor rolls. This arrangement also requires a much more elaborate drive mechanism inasmuch as the drive must extend longitudinally along the length of the apparatus so as to effect individual driving of the numerous rolls.

Accordingly, it is an object of this invention to provide an improved separator apparatus which is particularly desirable for effecting separation of blow-molded parts, and which overcomes many of the above-mentioned disadvantages.

In the improved separating apparatus of this invention, there is provided an elongated belt-type separator which is disposed directly below and extends longitudinally along the gap defined at the lower end of a substantially V-shaped collection and discharge chute. This belt-type separator preferably employs at least two endless belts disposed in side-by-side relationships, which belts are uniformly sidewardly spaced apart. The belts are preferably of circular cross section. The belts are disposed with their upper reaches extending substantially parallel with one another in sidewardly spaced relationship, which upper reaches may be at the same or slightly different elevations. Drive pulleys engage the belts adjacent one end thereof, and these pulleys are preferably of different diameter so that the upper reach of one belt moves at a greater speed than the upper reach of the adjacent belt. The spacing between the upper reaches of the belts and between the edges of the chute are such as to prevent the bottles from falling downwardly onto a flat conveyor belt which is disposed below the separator belts. The bottles are supported on the separator belts and conveyed longitudinally for discharge at one end of the apparatus. The moils and tails, however, can freely pass downwardly through the gaps or spaces between the belts and between the belts and the edges of the discharge chute. If the moils and tails happen to straddle the upper reaches of two adjacent belts, then the differential speed between the belts and the continual rotational twisting of the belts, presumably due to the bending of these belts around the drive and idler pulleys, causes the moils and tails to be turned and reoriented until they fall into and pass through the spaces for collection on the underlying conveyor belt.

In the improved separating apparatus of this invention, as aforesaid, the side rails defining the chute can be individually adjusted toward and away from one another so as to vary the width of the gap, and the individual pulleys which support the individual belts can also be appropriately axially adjusted toward or away from one another, such as by loosening the drive pulleys and then resecuring them to the drive shaft at a different axial location, whereby the spacing between adjacent belts, and the gaps between the sidewardmost belts and the edges of the chute, can be easily and uniformly adjusted to permit optimum separation depending upon the size of the bottles in relationship to the moils and tails. This adjustment can be accomplished in an efficient and time-saving manner.

Other objects and purposes of the invention will be apparent to persons familiar with structures of this general type upon reading the following specification and inspecting the accompanying drawings.

DETAILED DESCRIPTION

Figure 3:
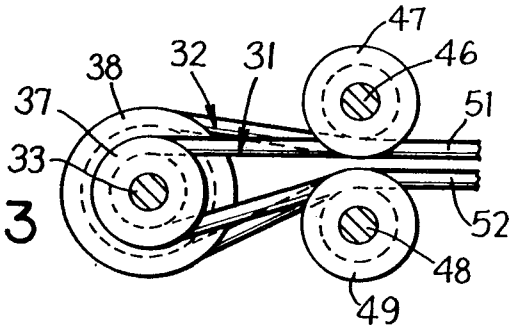
FIG. 3 is an enlarged fragmentary view showing the drive pulleys for the belts.
Figure 4:
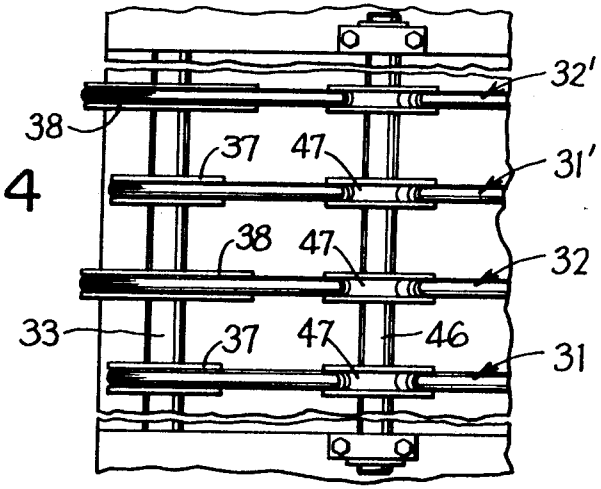
FIG. 4 is a fragmentary top view along line IV—IV in FIG. 1.

Referring to the drawings, there is illustrated an apparatus 11 according to the present invention, which apparatus is particularly desirable for effecting separation of blow-molded parts. In this regard, reference is made to FIG. 6 which illustrates several different blow-molded parts supported on the apparatus 11. The blow-molded parts include a conventional blow-molded bottle or container 1, a "tail" 2 which is formed integral with and projects outwardly from the bottom wall of the container, which tail is snapped off of the container, and a "moil" 3 which is the ring of excess plastic material which is cut from the mouth of the bottle 1. The tail 2 and moil 3 are effectively scrap parts which must be separated from the bottles 1, which scrap parts can then be recycled. These moils and tails will hereinafter be referred to solely as the scrap parts for purposes of distinguishing them from the containers 1.

The separator apparatus 11 includes a housing 12 which supports thereon a belt separator 13 for effecting separation between the containers 1 and the scrap parts 2,3. A conveyor belt arrangement 14 is positioned below the belt separator 13 for collecting and discharging the scrap parts.

The housing 12 generally resembles an elongated upwardly opening box and is formed by a pair of substantially parallel upright sidewalls 16 joined together by a bottom wall 17. The housing 12 is supported by a plurality of legs 18 which are preferably vertically adjustable and provided with rollers to facilitate adjustment and movement of the apparatus for convenience of use.

To permit the mixture of molded parts 1-3 to be supplied to the apparatus, the housing 12 mounts thereabove a substantially V-shaped chute structure 21 which is elongated substantially longitudinally of the housing. This chute structure 21 includes a pair of opposed side rails 22 which extend longitudinally of the housing and are disposed adjacent the opposite sides thereof. These side rails 22 project upwardly of the housing and are inclined outwardly in opposite directions relative to the vertical. Side rails 22 at their lower longitudinally extending edges are hinged at 23 to respective substantially horizontal support plates 24, which plates project sidewardly of the housing. The support plates 24 are slidably supported on substantially horizontal top flanges 19 which are fixed to and project outwardly from the upper edges of the housing sidewalls 16. The support plates 24 have sidewardly elongated slots 25 at several longitudinally spaced locations, and appropriate threaded fasteners 26 extend through these slots 25 for securement to the underlying flanges 19. This enables the rails 22 to be adjustably moved inwardly and outwardly relative to the housing and then secured in the selected position, thereby varying the width of the discharge gap 29 as located between the lower longitudinally extending parallel edges of the side rails 22. The mixture of parts is fed downwardly into this gap 29 due to the converging chutelike region 28 defined between the side rails 22.

The discharge gap 29 at the lower end of the chute structure 21 extends longitudinally along the housing and is positioned directly over the belt separator 13 for permitting the mixture of blow-molded parts to be supplied thereto. This belt separator 13 preferably includes at least two endless belts 31 and 32 positioned in adjacent side-by-side relationship. In the preferred embodiment of the invention, the belt separator is provided with an additional pair of belts 31' and 32', which belts are respectively identical to the belts 31 and 32, with all four belts being effectively positioned within parallel vertical planes which are disposed closely adjacent one another and extend longitudinally of the housing.

In the following description, the structure and operation of solely the belt pair 31-32 will be described, it being understood that the belt pair 31'-32' is identical thereto.

To effect driving of the belts 31-32, there is provided a drive shaft 33 which extends transversely between the sidewalls of the housing adjacent one end thereof. This drive shaft 33, which extends substantially horizontally, is rotatably supported on the housing and has one end thereof projecting sidewardly through one of the housing sidewalls into a control housing 34. A variable speed motor 35 is disposed within this control housing and is connected by an intermediate drive transmitting means 36, such as a chain drive, to a pulley mounted on the end of shaft 33 for effecting rotation thereof. First and second drive pulleys 37 and 38 are nonrotatably secured to the drive shaft 33 in closely adjacent but axially spaced relationship. These drive pulleys 37 and 38 are individually nonrotatably secured to the shaft 33, as by a set screw arrangement. The second drive pulley 38 preferably has a diameter which is greater than the diameter of the first drive pulley 37, the purpose of this diameter differential being explained hereinafter.

The drive pulleys 37 and 38 respectively support and drivingly engage the belts 31 and 32 at one end thereof, and the other ends of these belts are supported by individual end idler pulleys 39 which are individually rotatably supported on a shaft 41. This shaft 41 extends transversely of the housing adjacent the other end thereof, with the shaft being mounted on a yokelike support block 42. This block 42 is linearly slidably supported by elongated guides or grooves 43 which extend in the longitudinal direction of the housing. An adjustable locating means 44, such as a threaded shaft, is coupled between the housing and the block 42 so as to adjust the position of the idler pulleys 39. This permits the idler pulleys to be moved inwardly when mounting or replacement of a belt is desired, and additionally permits the shaft to be selectively positioned so as to properly tension the belts 31 and 32.

Adjacent the driving ends of the belts, there is provided an upper idler shaft 46 which extends across the housing in substantially parallel relationship with the drive shaft 33. This upper idler shaft supports thereon a plurality of upper idler pulleys 47 which are individually rotatably supported on the shaft 46. These upper idler pulleys 47 are all of the same diameter and are individually positioned above and disposed for engagement with an upper reach 51 of one of the belts 31,32, 31' and 32'.

A similar lower idler shaft 48 extends transversely across the housing in close proximity to and substantially parallel to the drive shaft 33. In fact, this lower idler shaft 48 is generally positioned directly downwardly from the upper idler shaft 46. A plurality of axially adjacent identical lower idler pulleys 49 are individually rotatably supported on this lower shaft 48, which pulleys in their entirety are disposed below but individually maintained in supportive engagement with a lower belt reach 52 of one of the belts 31,32, 31' and 32'.

The provision of the upper idler pulleys 47 and their rotational support on a common shaft 46 is important since each idler pulley 47 is disposed for engagement with the upper belt reach 51 of one of the belts at a location which is close to but downstream from the drive pulleys 37 and 38. Since these drive pulleys 37 and 38 are of different diameters, the belts 31 and 32 as they move away from the upper portions of these pulleys are disposed at different elevations. Thus, the upper idler pulleys 47 and their engagement with the upper reaches of the belts ensures that the upper reaches 51 of the belts 31 and 32 are disposed substantially at the same elevation as they extend downstream from the upper idler pulleys 47. These upper reaches 51 thus extend substantially horizontally in side-by-side and parallel relationship and have the upper surfaces thereof substantially horizontally coplanar.

In addition to the lower idler pulleys 49 disposed adjacent the driving pulleys 37 and 38, there is additionally provided a further plurality of lower idler pulleys 54 which are individually rotatably supported on a transverse shaft 55, the latter being disposed closely adjacent the other end of the housing in close proximity to the end idler pulleys 39. The lower idler pulleys 49 and 54 are preferably supported at elevations such that their engagement with the lower belt reaches 52 results in these lower belt reaches 52 being deflected upwardly relative to the adjacent driving and end idler pulleys. The lower belt reaches 52 are thus positioned parallel to and closely adjacent the upper belt reaches 51, but are disposed downwardly therefrom by only a small clearance distance therebetween, which clearance distance is preferably no more than about one-half inch and in most instances is about one-fourth inch. This positioning of the upper and lower belt reaches closely adjacent one another in direct overlying relationship prevents the creation of any significant gaps between the upper and lower reaches, which gaps might tend to trap the scrap parts 2-3.

The idler pulleys 47,49 and 54 are free to float or move axially relative to their respective shafts so as to accommodate and adjust to the selected spacing between the belts.

The belts 31 and 32 preferably have a rounded or circular cross section, such as about one-fourth to one-half inch in diameter, and are normally constructed of an elastomeric material, namely a plastic material such as polyurethane.

The belt separator 13 is disposed directly over the conveyor belt arrangement 14 so as to permit the separated scrap parts 2-3 to be deposited on this latter belt. The conveyor belt arrangement 14 includes an endless flat belt 61 having a substantially horizontally extending upper reach 62 on which the scrap parts 2-3 are deposited. The belt 61 extends between rotatable drive and idler rollers 63 and 64 which are rotatably supported relative to and extend transversely across the housing adjacent the opposite ends thereof, whereby the upper reach 62 of the belt extends below but substantially parallel with the horizontally extending reaches of the belts 31 and 32. The drive roller 63 is nonrotatably secured to a drive shaft 65 which projects outwardly through the sidewall of the housing and is connected through a motion transfer means 66, such as a chain arrangement, to either the motor 35 or to a separate motor if desired. The idler roller 63 is preferably mounted on a shaft 67 which in turn is mounted on an adjustable slide block mechanism 68 so as to adjust the tension of the belt 61.

The operation of the separator apparatus 11 will be briefly described to ensure a complete understanding thereof.

Figure 1:
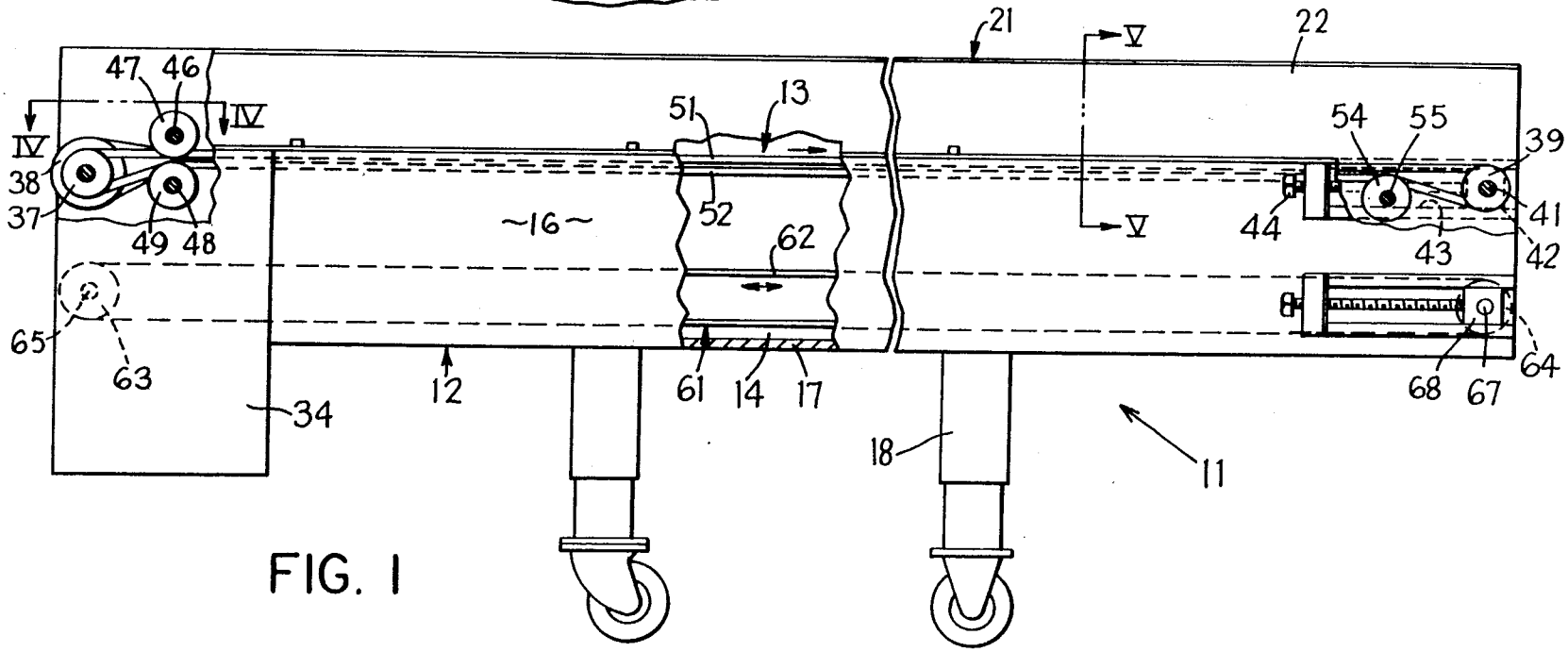
FIG. 1 is a side elevational view of the improved separator apparatus.
Figure 2:
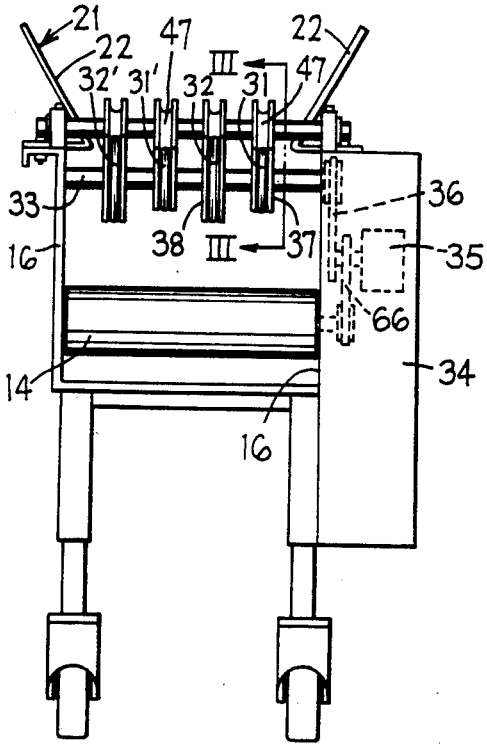
FIG. 2 is a left end elevational view of FIG. 1.

The motor 35 causes rotation of the driving pulleys 37 and 38, which pulleys cause the upper reaches 51 of the belts 31-32 and 31'-32' to move horizontally forwardly in the direction indicated by the arrow in FIG. 1. Since the second drive pulley 38 is of larger diameter than the first drive pulley 37, this causes the second belt 32 to move at a linear speed or velocity which is greater than the linear speed of the first belt 31, the difference being in proportion to the difference in diameter between the pulleys 37 and 38. For this purpose, the diameter of pulley 38 is preferably at least 10% greater than the diameter of pulley 37 so that the speed of belt 32 will be at least 10% greater than the speed of belt 31. The ratio between the diameters of pulleys 38 and 37 could be as much as 3:1, thus resulting in a 3:1 speed ratio between the belts 32 and 31. A more preferably speed ratio, as achieved by the diameter ratio between pulleys 38 and 37, however, is in the range of from about 5:4 to about 3:2. That is, the belt 32 preferably has a linear speed or velocity which is in the range of about 25% to about 50% greater than the linear speed of the belt 31.

When the mixture of molded parts 1-3 is deposited into the chute structure 21, the parts are funneled downwardly through the chute to the discharge gap 29 for engagement with the linearly moving belts 31-32 and 31'-32'. The transverse spaces or gaps 58 between the adjacent belts, and between the sidewardmost belts and the lower edges of the rails 22, are smaller than the minimum dimension of the bottles or containers 1. The bottles can thus not pass downwardly between the belts, but instead remain on the belts and are transported longitudinally along the apparatus for discharge at one end thereof, namely the rightward end in FIG. 1. During this transporting of the bottles or containers longitudinally through the apparatus, it has been observed that the differential velocity between the adjacent side-by-side belts causes a turning of the bottles or containers so that they tend to longitudinally align themselves in the longitudinal direction of the apparatus.

Figure 6:
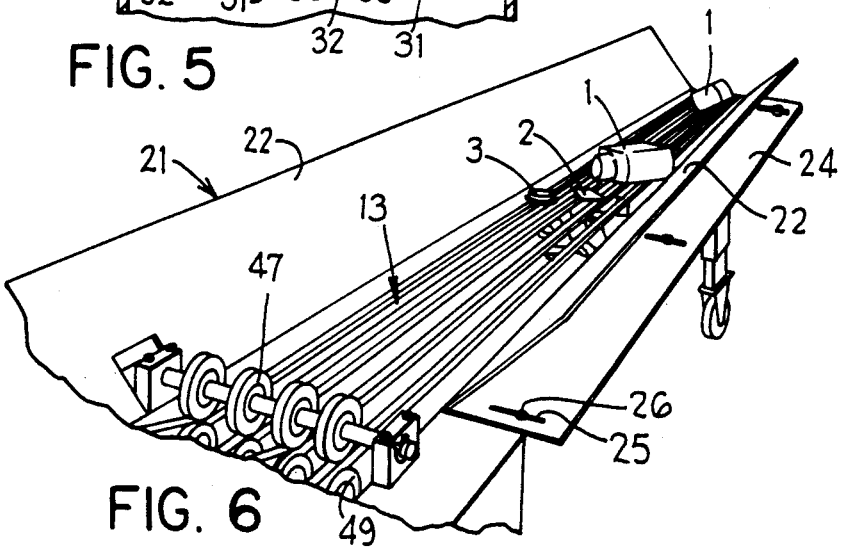
FIG. 6 is a perspective view of the apparatus.

With respect to the smaller tails 2 and moils 3, some of these will readily fall downwardly through the spaces 58 for deposit on the underlying conveyor belt 61. However, the tails and moils generally have a dimension within at least one plane or direction which is greater than the transverse width of the spaces 58. Some of the tails and moils will initially straddle the upper reaches 51 of two adjacent belts as illustrated in FIG. 6. However, due to the speed differential between the upper reaches of each adjacent pair of belts, this speed differential causes the parts 2-3 which straddle adjacent belts to effectively rotate within the horizontal plane defined by the upper contact surfaces of the belts. As the scrap parts are rotated due to the belt speed differential, this also results in some sideward displacement of the parts until the parts lose engagement with at least one of the belts and fall into and through the spaces 58.

In addition to the beneficial effect achieved by the speed differential between adjacent belts, as explained above, it has been observed that the use of round belts also provides an advantageous operation with respect to effecting separation of the parts 2-3. These round belts 31-32 have been observed to continually twist or oscillate in a somewhat back-and-forth manner relative to the longitudinally extending axis of the belt. While the exact reason for this twisting is not known, nevertheless it is presumably due to the stresses which are set up internally of the belt due to the wrapping of the belt around the end pulleys. This twisting or oscillating characteristic of the round belts further assists in sidewardly displacing the scrap parts 2–3 which straddle adjacent belts, and hence assists in causing these scrap parts to disengage at least one of the belts and fall into and through the intermediate spaces 58.

The separating of the scrap parts 2–3 is believed further assisted by the vibration of the elongated upper reaches of the belts 31 and 32. These belts are elastic and are tensioned as they stretch between the end pulleys. This has been observed to create a very small amplitude vibration of the belts as they move between the end pulleys. This vibration, which to some extent can be controlled by adjusting the end idler pulley and hence adjusting the tension in the belts, further assists in moving or agitating the scrap parts 2–3 so as to cause them to fall into and through the spaces 58.

Figure 5:
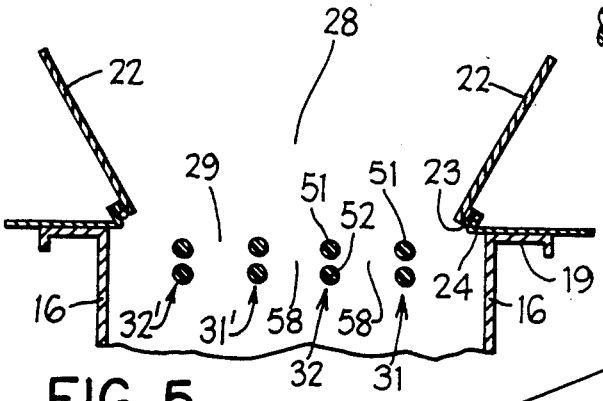
FIG. 5 is an enlarged fragmentary sectional view along line V—V in FIG. 1.

If desired, the side rails 22 can be moved inwardly (see FIG. 5) to reduce the gap and in fact cover some of the belts so that a reduced number of belts (i.e., two) would be used for effecting separation.

Figure 7:
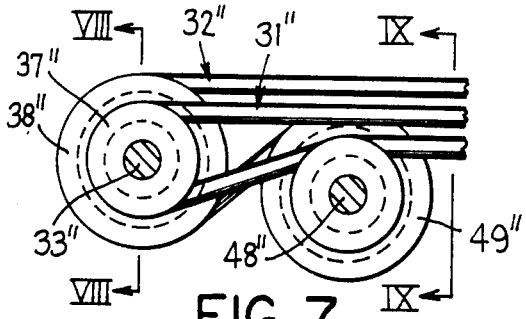
FIG. 7 is a view like FIG. 3 but illustrating a variation.
Figure 8:
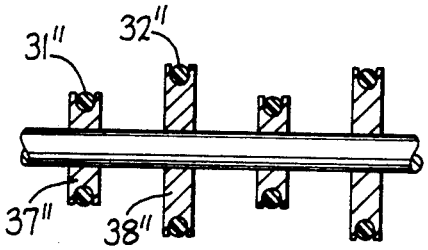
FIGS. 8 and 9 are views along lines VIII—VIII and IX—IX, respectively, in FIG. 7.
Figure 9:
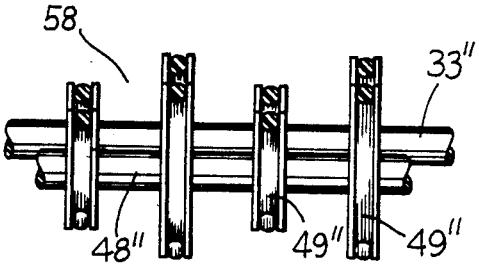

Referring now to FIGS. 6–8, there is illustrated a variation of the apparatus according to the present invention, which variation relates primarily to the elimination of the upper idler pulleys 47 such that the upper belt reaches extend in horizontally parallel but vertically staggered relationship.

In this embodiment, the belts designated 31'' and 32'' again extend over alternate driving pulleys 37'' and 38'' of different diameters so as to provide each belt with a different speed. In this case, however, the upper belt reaches project horizontally directly away from the driving pulleys, so that the upper reaches of each adjacent pair of belts are disposed at different elevations. The upper reaches of the adjacent belt pairs thus define the staggered or stepped arrangement illustrated by FIG. 8. In some instances, this arrangement is believed preferable since the vertically staggered relationship between the adjacent upper reaches makes it more difficult for the scrap parts 2–3 to straddle the adjacent belts, and additionally results in these parts more effectively being forced into an inclined relationship to assist their entry into the spaces 58 for downward discharge onto the underlying conveyor belt. With this arrangement, the lower idler pulleys 49'' are preferably of different diameters so that the lower belt reaches will be positioned closely adjacent the upper belt reaches to prevent the creation of any large gaps between the upper and lower reaches.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A separator apparatus for effecting separation of a mixture of parts, such as blow-molded plastic parts, comprising:

a housing means;

elongated separator belt means movably mounted on said housing means for effecting separation of a mixture of parts by permitting first parts to fall therethrough while supporting second parts and transporting them to a discharge location;

said separator belt means including at least two endless belts movably supported on the housing means, said belts having elongated upper belt reaches which extend approximately horizontally of the housing means, said upper belt reaches extending in substantially parallel and adjacent side-by-side relationship and being provided with a small predetermined clearance space therebetween through which said first parts can pass, each said belt also including a substantially horizontally elongated lower belt reach which extends substantially parallel with and vertically spaced downwardly below the respective upper belt reach;

guide means aasociated with said housing means for funneling a mixture of said parts into a region directly above said upper belt reaches;

drive means for moving said belts relative to said housing means and for causing one said belt to move at a speed which is at least slightly greater than the speed of the other belt, said drive means including drive pulleys engaging said belts adjacent one end thereof and end idler pulleys engaging said belts adjacent the other end thereof; and idler pulley means associated with each said belt for maintaining the upper and lower belt reaches of the respective belts in parallel but closely adjacent vertically spaced relationship so that the respective upper and lower belt reaches are vertically spaced apart by a small distance which is only a small fraction of the diameters of the drive and end idler pulleys.

2. An apparatus according to claim 1, wherein said guide means includes a pair of guide rails which are elongated longitudinally of said housing means and which have lower longitudinally extending edges which define a narrow but longitudinally elongated gap therebetween, and the upper belt reaches being disposed approximately at the elevation of said gap and extending longitudinally therealong.

3. An apparatus according to claim 2, wherein said belts have a rounded cross section.

4. An apparatus according to claim 3, wherein the upper belt reaches are substantially horizontally coplanar.

5. An apparatus according to claim 3, wherein the sidewardly adjacent upper belt reaches are disposed at slightly different elevations.

6. An apparatus according to claim 3, wherein there are at least four said belts disposed in sidewardly adjacent relationships so that the upper reaches of said four belts extend in substantially parallel and horizontal relationship with each adjacent pair of said belts being sidewardly spaced apart by a predetermined transverse spacing therebetween.

7. An apparatus according to claim 1, wherein said drive means includes a substantially horizontal drive shaft which extends transversely of said gap and nonrotatably mounts thereon first and second said drive pulleys in adjacent coaxially aligned relationship, said first drive pulley being disposed in driving engagement with a first belt of said pair and said second drive pulley being disposed in driving engagement with a second belt of said pair, said first and second drive pulleys being of different diameters for causing said first and second belts to move at different speeds.

8. An apparatus according to claim 7, including a plurality of coaxially aligned and individually rotatable upper idler pulleys rotatably supported on said housing means and individually disposed for rotatably engaging a respective upper belt reach at a location close to but slightly downstream from the respective drive pulley, at least one of said upper idler pulleys causing its upper belt reach to be deflected downwardly as it moves downstream away from its respective drive pulley so that the upper belt reaches of adjacent belts are substantially horizontally coplanar.

9. An apparatus according to claim 7, wherein said first and second sets of rotatable lower idler pulleys disposed adjacent the opposite ends of the lower belt reaches and individually engaging the lower belt reaches for causing the lower belt reaches to be deflected upwardly so as to be positioned substantially directly below the respective upper belt reaches and spaced downwardly therefrom by a small distance.

10. An apparatus according to claim 9, wherein each said belt has a circular cross section and is constructed of an elastomeric material.

11. An apparatus according to claim 10, wherein there are at least four said belts disposed in spaced side-by-side relationship, the upper reaches of each adjacent pair of belts moving at different speeds, and the belts being uniformly sidewardly spaced apart to define a uniform clearance space between each adjacent pair of belts.

12. An apparatus according to claim 10, wherein one belt of an adjacent pair moves at a speed which is at least 10% greater than the speed of the adjacent belt of said pair.

13. An apparatus according to claim 12, wherein said one belt moves at a speed which is in the range of between 25% and 50% greater than the speed of said adjacent belt.

14. A separator apparatus for effecting separation of a mixture of parts, such as blow-molded plastic parts, comprising:

a housing means;

elongated separator belt means movably mounted on said housing means for effecting separation of a mixture of parts by permitting first parts to fall therethrough while supporting second parts and transporting them to a discharge location;

said separator belt means including at least two endless belts movably supported on the housing means, said belts having elongated upper belt reaches which extend approximately horizontally of the housing means, said upper belt reaches extending in substantially parallel and adjacent side-by-side relationship and being provided with a small predetermined clearance space therebetween through which said first parts can pass;

guide means associated with said housing means for funneling a mixture of said parts into a region directly above said upper belt reaches;

drive means for moving said belts relative to said housing means and for causing one said belt to move at a speed which is at least slightly greater than the speed of the other belt;

said drive means including a substantially horizontal drive shaft which extends transversely of said gap and nonrotatably mounts thereon first and second drive pulleys in adjacent coaxially aligned relationship, said first drive pulley being disposed in driving engagement with a first belt of said pair and said second drive pulley being disposed in driving engagement with a second belt of said pair, said first and second drive pulleys being of different diameters for causing said first and second belts to move at different speeds; and a plurality of coaxially aligned and individually rotatable upper idler pulleys rotatably supported on said housing means and individually disposed for rotatably engaging a respective upper belt reach at a location close to but slightly downstream from the respective drive pulley, at least one of said upper idler pulleys causing its upper belt reach to be deflected downwardly as it moves downstream away from its respective drive pulley so that the upper belt reaches of adjacent belts are substantially horizontally coplanar.

15. An apparatus according to claim 14, wherein there are at least four said belts disposed in sidewardly adjacent relationships so that the upper reaches of said four belts extend in substantially parallel and horizontal relationship with each adjacent pair of said belts being sidewardly spaced apart by a predetermined transverse spacing therebetween, and said plurality of upper idler pulleys being engaged with all of said belts so that the upper reaches of all of said belts are substantially horizontally coplanar.

16. An apparatus according to claim 15, including idler pulley means associated with the lower reach of each said belt for maintaining the lower reach in parallel but closely adjacent vertically spaced relationship to its respective upper reach, said idler pulley means being engaged with the respective lower reach for deflecting it upwardly adjacent the opposite ends of said belts.

* * * * *